US007553062B2

(12) United States Patent
Spartano et al.

(10) Patent No.: US 7,553,062 B2
(45) Date of Patent: Jun. 30, 2009

(54) LIGHT DEVICE

(75) Inventors: David Spartano, Brunswick, OH (US); Kurt Matthew Richars, St. Louis, MO (US); John D. Crawford, Avon, OH (US); Scott W. Osiecki, Skaneateles, NY (US); Mark A. Ferguson, Memphis, NY (US)

(73) Assignee: Eveready Battery Company, Inc., St. Louis, MO (US)

( * ) Notice: Subject to any disclaimer, the term of this patent is extended or adjusted under 35 U.S.C. 154(b) by 233 days.

(21) Appl. No.: 11/523,150

(22) Filed: Sep. 19, 2006

(65) Prior Publication Data

US 2008/0068822 A1 Mar. 20, 2008

(51) Int. Cl.
*H01R 33/00* (2006.01)

(52) U.S. Cl. ..... 362/641; 362/95; 362/376; 362/378; 362/642; 362/644; 174/67; 439/135; 439/142

(58) Field of Classification Search ..... 362/95, 362/641, 644, 652, 653, 654, 659, 376, 378; 174/66, 67; 439/135, 136, 142, 147
See application file for complete search history.

(56) References Cited

U.S. PATENT DOCUMENTS

| | | | |
|---|---|---|---|
| 2,878,456 | A | 3/1959 | Cormier |
| 3,363,216 | A | 1/1968 | Benedetto |
| 3,811,104 | A | 5/1974 | Caldwell |
| 3,955,870 | A | 5/1976 | Wasserman |
| 4,228,317 | A | 10/1980 | Cziment |
| 4,250,349 | A | 2/1981 | Bennett |
| 4,546,419 | A | 10/1985 | Johnson |
| 4,660,912 | A | 4/1987 | Tomek |
| 4,671,587 | A | 6/1987 | Lerner et al. |
| 4,718,856 | A | 1/1988 | Pinkerton et al. |
| 4,723,823 | A | 2/1988 | Pinkerton et al. |
| 4,931,911 | A | 6/1990 | Hanson |
| 5,420,764 | A | 5/1995 | Hussain et al. |
| 5,481,442 | A | 1/1996 | Dickie et al. |
| 5,495,402 | A | 2/1996 | Houssian |
| 5,544,025 | A | 8/1996 | Bohlool et al. |
| 5,662,408 | A | 9/1997 | Marischen |
| 5,779,346 | A | 7/1998 | Burke |
| 5,964,516 | A | 10/1999 | Lai |
| 6,190,017 | B1 | 2/2001 | Lai |
| 6,805,580 | B2 | 10/2004 | Piedmont |
| 2004/0142601 | A1 | 7/2004 | Luu |
| 2005/0226006 | A1 | 10/2005 | Chen |

OTHER PUBLICATIONS

Patent Cooperation Treaty (PCT), International Search Report and Written Opinion for Application No. PCT/US2007/020329, Filed Sep. 19, 2007, Mailed Mar. 28, 2008, European Patent Office, Netherlands.

Tasco General Super Store, New Child Safety Auto Nightlight/Electric Outlet Guard, download Feb. 1, 2006, 9 pages, http://cgi.ebay.com/NEW-CHILD-SAFETY-AUTO-NIGHT-LIGHT-...

Tasco General Super Store, New 2 Pack Child Safety 2-Touch Standard Outlet Covers, downloaded Feb. 1, 2006, 7 pages, http://cgi.ebay.com/NEW-2-PACK-CHILD-SAFETY-2-TOUCH-S....

Totsafe.com, Nightlight with Outlet Product Details, downloaded Jan. 31, 2006, 2 pages, http://www.totsafe.com/productdetail.asp?prod=8309.

*Primary Examiner*—Stephen F Husar
(74) *Attorney, Agent, or Firm*—Gregory J. Adams

(57) ABSTRACT

A light device includes a body having a light source and electrical contacts that plug into a first electrical outlet of a duplex receptacle and receive power therefrom. An outlet cover mounted for pivotal motion with respect to the body about at a pivot axis, which is substantially proximate to a region between the first outlet and a second outlet of the receptacle. The outlet cover pivots away from the body and towards the duplex receptacle to inhibit access to the second electrical outlet.

30 Claims, 10 Drawing Sheets

LIGHT DEVICE

BACKGROUND OF THE INVENTION

The following generally relates to a light device. More particularly, it pertains to an electrical outlet powered night light having a moveable structure that moves into a position that inhibits access to a second electrical outlet.

A typical conventional night light includes a light source powered through electrical contacts that receive power from a wall or otherwise mounted electrical receptacle. Depending on the type of light source (e.g., an incandescent light bulb), a shield may be attached to the night light to provide a barrier between the light source and the environment.

In many instances, such a night light is configured to be left in place once plugged into the electrical receptacle. As such, conventional night lights typically are constructed so as not to interfere with access to an adjacent electrical outlet when plugged into one of the outlets of a duplex receptacle. This allows the user to plug in the night light in one of the outlets and plug a different device into the other outlet without having to move the night light. However, in some instances, this is undesirable. For example, in one instance the user may desire to prevent access to the adjacent electrical outlet to prevent individuals such as children from accessing the outlet or other devices from receiving power through the outlet.

Many attempts have been made to develop a night light that blocks access to the unused receptacle of the duplex receptacle. For example, U.S. Pat. No. 5,544,025 to Bohlool et al. discloses an night light/outlet cover plate that screws to a duplex electrical receptacle. The night light/outlet cover plate is a single unitary assembly with an enclosed night light portion having electrical contacts that plug into a first outlet of a duplex receptacle and a cover plate portion that covers an area around the receptacles and blocks access to the second outlet of the receptacle.

Consequently, the night light/outlet cover plate is the duplex electrical receptacle cover plate. Thus, in order to access the unused outlet or remove the night light, if desired, the entire cover plate must be removed, which requires unscrewing the attachment screws and exposing the electrical wires powering the outlets. In addition, the portion blocking access to the second outlet of the receptacle is merely an extension of the outlet cover plate and does not conform to the aesthetics of the night light portion.

In another example, patent U.S. Pat. No. 5,964,516 to Lai discloses a single night light wall outlet structure that covers both outlets of a duplex receptacle. The single structure provides access to the outlets of the duplex receptacle through two openings within the structure. The electrical contacts of the night light extend through one of the openings and into one of the outlets, and the other outlet is accessible through the other opening. An outlet shield is pivotally attached to the structure such that it sits to one side of (e.g., below) both outlets. When the outlet shield is pivoted toward the light source, it blocks access to the outlet, and when the outlet shield is pivoted away from the light source, the shield hangs below the receptacle.

Unfortunately, since the structure covers both outlets, the night light cannot be plugged in unless the other outlet is not being used. Likewise, once plugged in, the night light cannot be removed unless the other outlet is not being used. In addition, the shape of the opening to the outlet and the size of the cover plate structure limit the type of the plug that can be plugged into the outlet through the opening. Moreover, when using the outlet to power another device, the outlet shield hangs down past the duplex receptacle, exposing the shield and the structures on the inside of the shield, including a pivot, pivot connectors, a portion of the shield mounted to the pivot, engagement hooks, and finger gripping recesses, such that they are susceptible to damage.

In view of the above, there is an unresolved need for an improved night light.

BRIEF SUMMARY OF THE INVENTION

According to one aspect, a light device includes a body having a light source and electrical contacts that plug into a first electrical outlet of a duplex receptacle and receive power therefrom. An outlet cover mounted for pivotal motion with respect to the body about a pivot axis that is substantially proximate to a region between the first outlet and a second outlet of the receptacle. The outlet cover pivots away from the body and towards the duplex receptacle to inhibit access to the second electrical outlet.

According to another aspect, a night light has a light source that is energized by the power from a first outlet of the duplex receptacle. The night light further includes a pivot that is disposed parallel and near to a region between two outlets of the receptacle. An extension pivots about the pivot to block access to a second electrical outlet of the duplex receptacle.

According to another aspect, a method for attaching a nightlight to an electrical outlet includes electrically coupling electrical contacts of the night light to a first outlet of an duplex electrical receptacle, and pivoting an outlet cover of the night light about a pivot axis located between and parallel to the outlets of the receptacle to prevent access to a second outlet or provide access to the second outlet.

According to another aspect, a method for constructing a night light that blocks access to an electrical outlet includes assembling a night light that plugs into an outlet of a duplex electrical receptacle, and pivotably coupling an extension member to a pivot axis of the night light located between the outlets of the receptacle, wherein the extension member pivots about the axis towards the receptacle to block access to a second outlet of the receptacle.

Still other aspects of the present invention will be understood by those skilled apart upon reading and understanding the appended description and drawings.

DETAILED DESCRIPTION OF THE INVENTION

Figure 1:
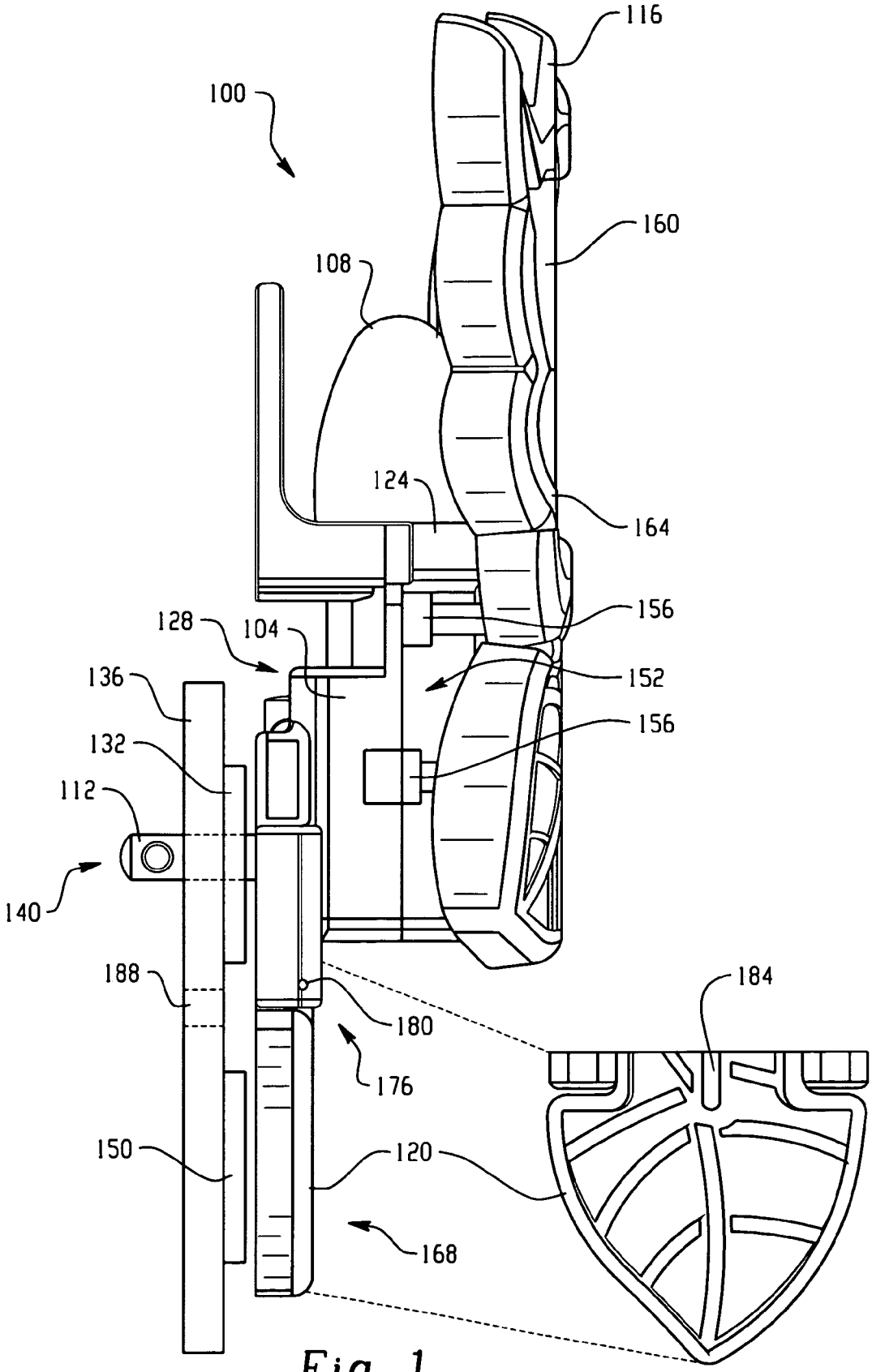
FIG. 1 illustrates a side view of a light device with an outlet cover in an extended position that blocks access to an electrical outlet.
Figure 2:
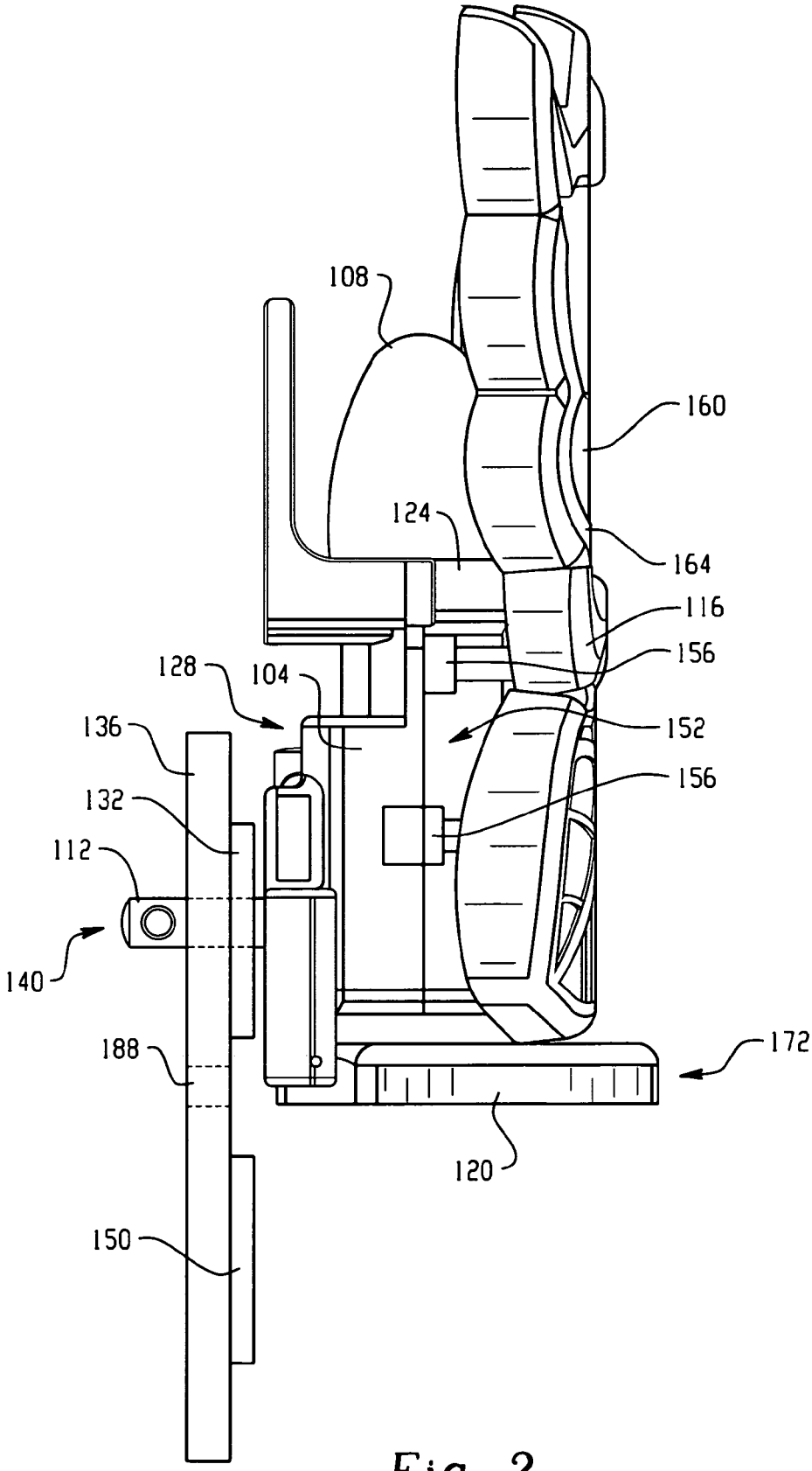
FIG. 2 illustrates a side view of a light device with an outlet cover in a retracted position that provides access to an electrical outlet.

With reference to FIGS. 1 and 2, a light device 100 includes a body 104, a light source 108, electrical contacts 112, an optional faceplate 116, and an outlet cover 120.

The body 104 includes a portion 124 for receiving the light source 108. In the illustrated embodiment, the light source 108 is an ordinary four (4) watt (W) incandescent night-light light bulb that screws or otherwise attaches within the portion 124. The body 104 further houses components (not visible) for electrically coupling the light source 108 to the electrical contacts 112.

Figure 3:
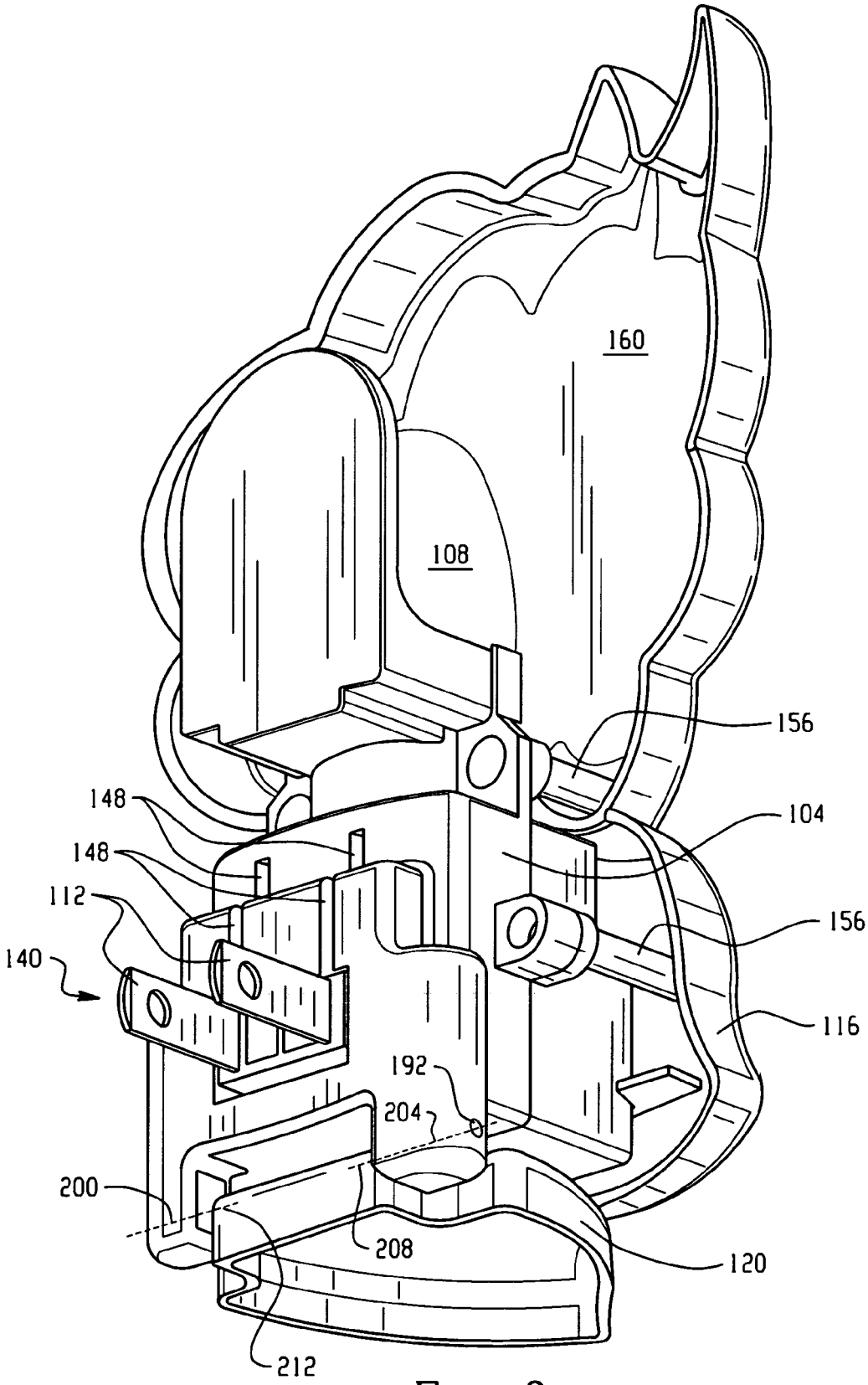
FIG. 3 illustrates a back perspective view of a light device with an outlet cover in a retracted position and attached through a pivot component(s).
Figure 4:
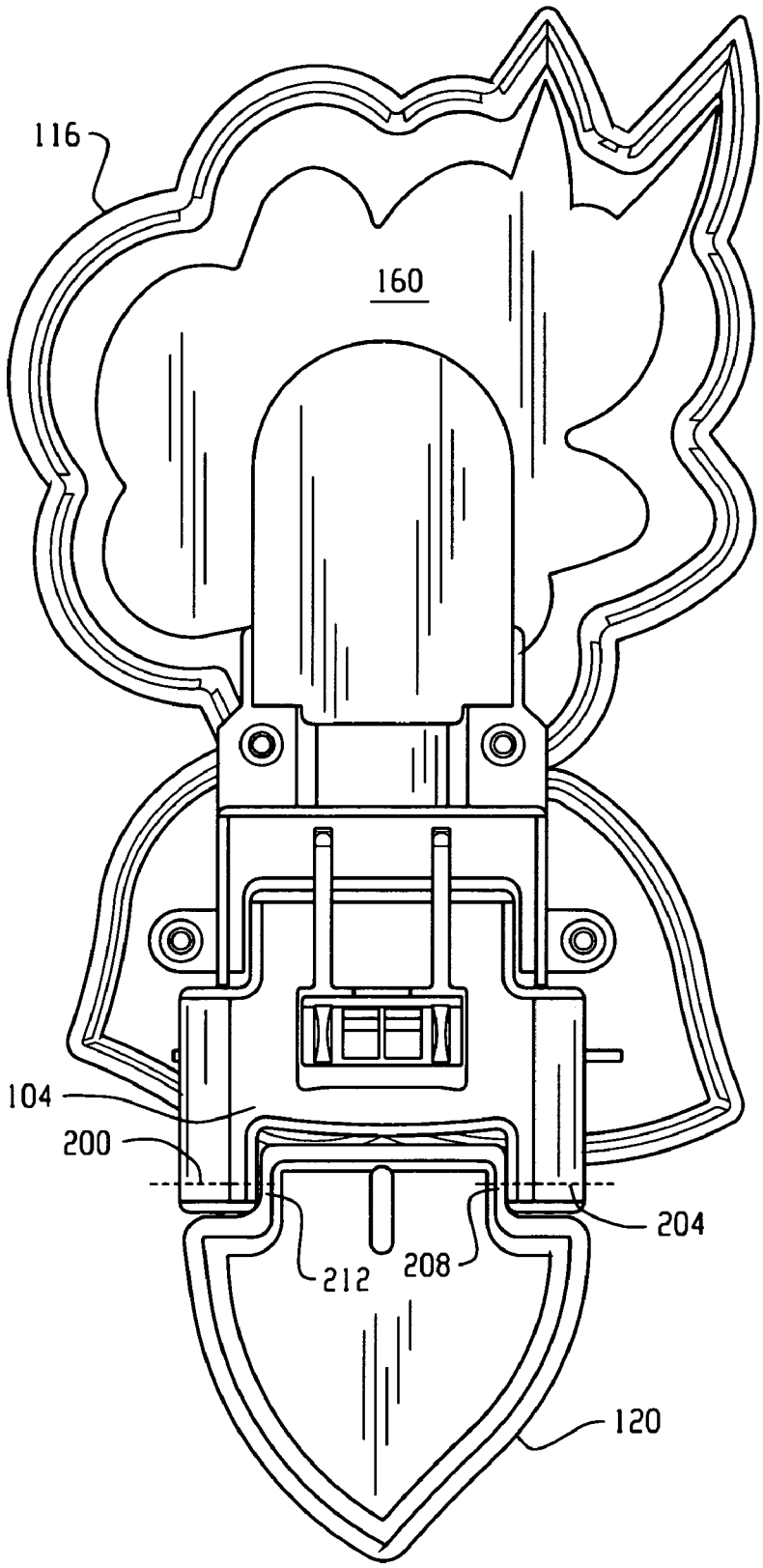
FIG. 4 illustrates a back view of a light device with an outlet cover in an extended position and attached through a pivot component (s).
Figure 5:
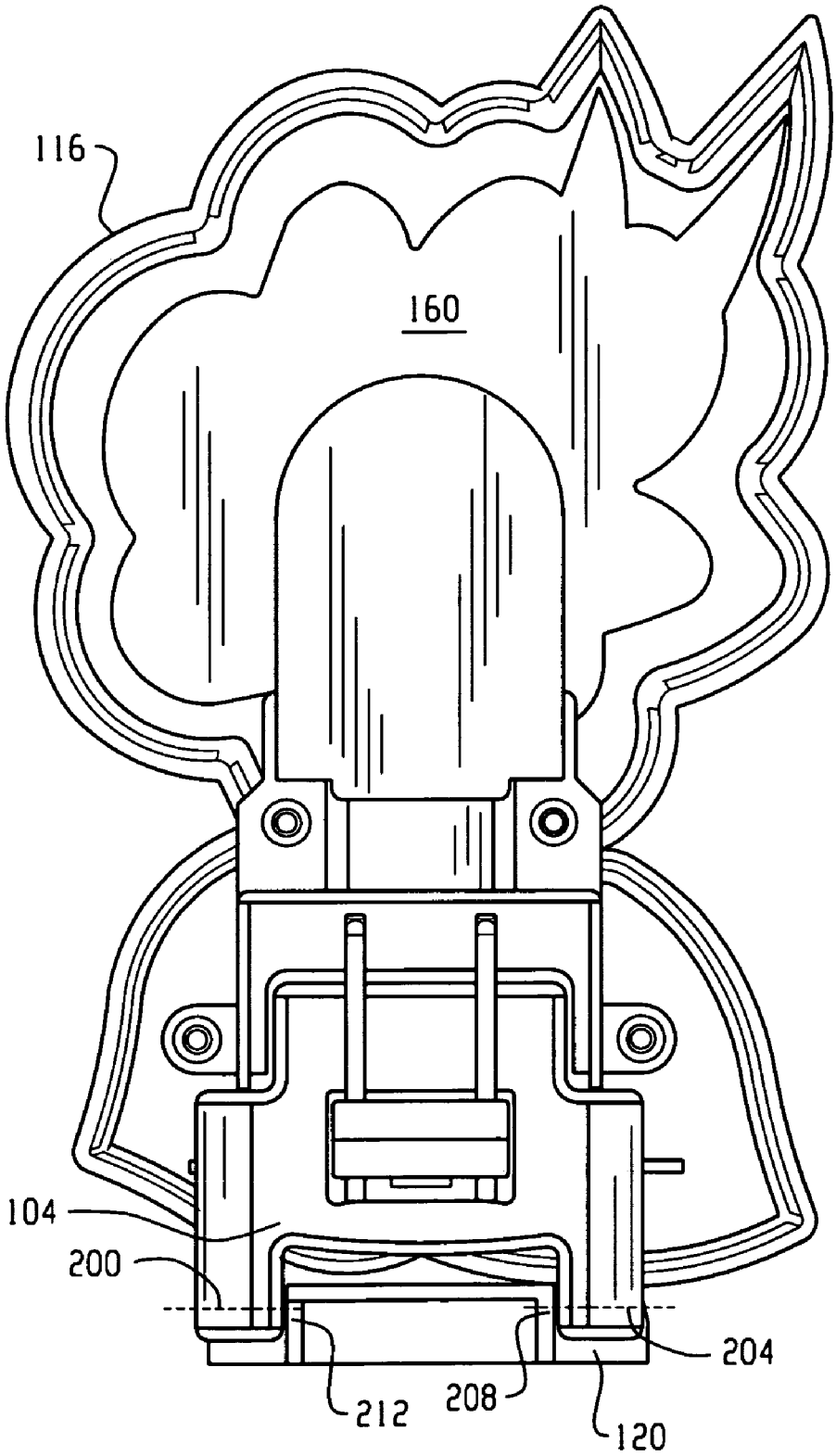
FIG. 5 illustrates a back of a light device showing an outlet cover in a retracted position and attached through a pivot component(s).

The light device 100 includes two non-polarized electrical contacts 112 that extend from on a first side 128 of the body 104 and that plug into a first outlet 132 of a standard 120 volts alternating current (VAC) 50/60 Hertz (Hz) duplex electrical receptacle 136. The electrical contacts 112 are optionally pivotably mounted, and are shown in FIGS. 1 and 3 in a first position 140 for plugging into the first outlet 132 and in FIG. 2 in a second position 144 in which the electrical contacts 112 move into storage recesses 148. When plugged into the first outlet 132, power from the first outlet 132 energizes and illuminates the light source 108, when the light device 100 is activated. An optical sensor (not visible) or the like activates the light source 108 under low ambient light conditions.

The optional faceplate 116 attaches to a second side 152 of the body 104. In the illustrated embodiment, the faceplate 116 is mounted to the body 104 at mechanisms 156 with screws or the like. The faceplate 116 includes an optical portion 160 that spreads or diffuses light emitted by the light source 108. The optical portion 142 is recessed within the faceplate 116 and partially or completely surrounded by a lip 164. An object such as a translucent sticker or the like is affixed to optical portion 142. The lip 164 protects the edges of the object.

The outlet cover 120 is movably mounted to the light device 100 for motion between a first or extended position 168 illustrated in FIG. 1 and a second or retracted position 172 illustrated in FIG. 2. In the first or extended position 168, the outlet cover 120 substantially covers the second outlet 150 such that access to the second outlet 150 is blocked or substantially impeded. The second or retracted position 172 provides access to the second outlet 150.

The outlet cover 120 is mounted on the first side 128 of the body 104 at a region 176 between the first outlet 132 and the second outlet 150 when the light device 100 is plugged into the first outlet 132. As illustrated, the outlet cover 120 is mounted for pivotal motion about a pivot or rotation axis 180. The pivot axis 180 is physically located between the first and second outlets 132 and 150, relatively nearer to the first outlet 132. The pivot axis 180 is also substantially parallel to the electrical receptacle 136.

In the first or retracted position 172, the outlet cover 120 is rotated toward the body 104 and away from the duplex receptacle 136. As illustrated, the dimensions of the outlet cover 120 are selected so that one end of the outlet cover 120 protrudes slightly past a front surface of the faceplate 116. The protruding portion of the outlet cover 120 provides a lip that a user utilizes when moving the outlet cover 120 toward the first or extended position 168. The protrusion can be omitted.

The outlet cover 120 includes a slot or hole 184 at which the outlet cover 120 attaches to the electrical receptacle 136. The slot 184 is configured to provide access to a threaded hole 188 in the electrical receptacle 136. The dimension of slot 184 allows the screw to be slightly moved closer or farther from one of the outlets 132 and 150 to accommodate different receptacle orientations. For example, the screw can be suitably positioned for attaching to the screw hole 188 when the receptacle 136 is configured to receive a three (3) prong plug and the receptacle is oriented with the ground recess nearer to the light source 108 than the hot and neutral recesses or with ground recess farther to the light source 108 than the hot and neutral recesses. When attached, the screw secures the outlet cover 120 in the first or extended position 168 to block access to the outlet 150. It can also be used to prevent the light device 100 from being unplugged.

One exemplary attachment between the outlet cover 120 and the body is illustrated in FIGS. 3, 4, 5, and 6. In these figures, the outlet cover 120 is attached to the body 104 by way of two pivots 192 (visible in FIGS. 3 and 6) and 196 (visible in FIG. 6) such as pins or rods, which are inserted in corresponding material free regions 198 and 200 in the body 104 and material free regions 204 and 208 in the outlet cover 120. In one instance, the dimensions of the pivots 192 and 196 and the material free regions 200, 204, 208, and 212 are selected so that the pivots 192 and 196 are inserted with an interference fit. Such an arrangement aids in holding the pivots 192 and 196 in place and in maintaining the outlet cover 120 in position. In another embodiment, the pivots snap or otherwise engage in the regions 200, 204, 208, and 212. Alternately, a single, relatively longer pivot or more than two (2) pivots are used.

Figure 6:
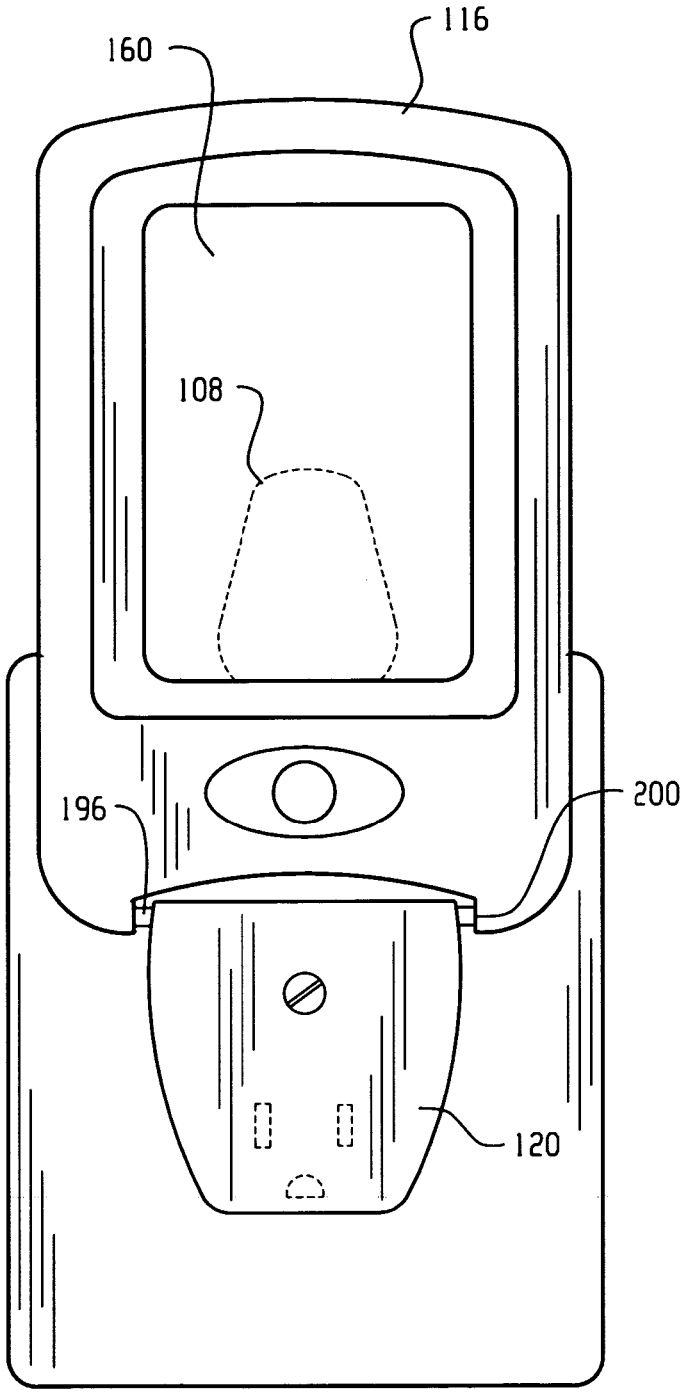
FIG. 6 illustrates a front view of a light device showing an outlet cover having an integral pivot(s).

With particular reference to FIG. 6, in an alternative embodiment one or more of the pivots 192 and 196 are formed as an integral part of the body 104 or the outlet cover 120, for example, during a molding operation. When formed as part of the body 104, the pivots 192 and 196 extend from the body 104 to snap or otherwise engage the material free regions 208 and 212 of the outlet cover 120 shown in FIG. 3-5. When formed as part of the outlet cover 120, the pivots 192 and 196 extend from the outlet cover 120 to snap or otherwise engage the material free regions 200 and 204 of the body 104 shown in FIG. 3-5.

Figure 7:
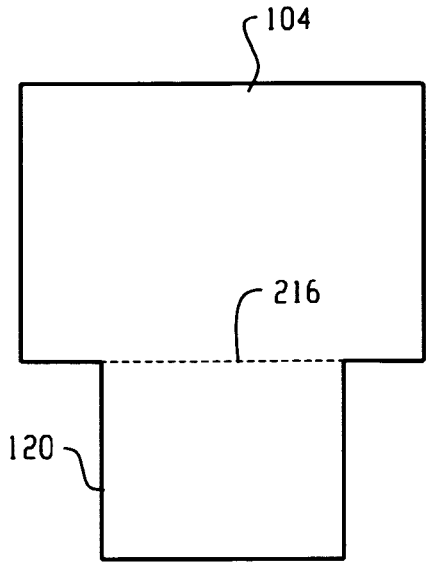
FIG. 7 illustrates a light device with an outlet cover that is breakably removable from the light device.

FIG. 7 shows another implementation in which the outlet cover 120 and the body 104 are formed as a single structure, with the outlet cover 120 in the first or extended position 168. In one instance, the outlet cover 120 is breakably removable from the body 104 at a region 216. In such an arrangement, a user permanently removes the outlet cover 120 by severing the region 216, for example, by bending the outlet cover 120 between the first position 168 and the second position 172, one or more times.

Figure 8:
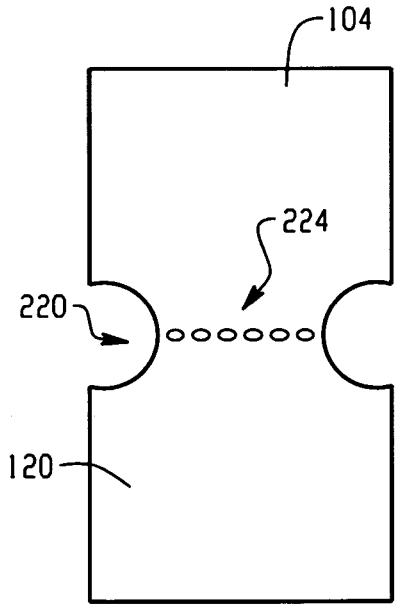
FIG. 8 illustrates light device with a flexibly moveable outlet cover.

In the implementation illustrated in FIG. 8, the outlet cover 120 is formed as an integral part of the body 104 using a flexible plastic. In one instance, a relatively narrower or necked down region 220 allow for flexure of the outlet cover 120. In the illustrated example, the flexure is provided via one or more perforations 224, such as slots or holes, in the region 220 or otherwise.

In another embodiment, the body 104 and outlet cover 124 are coupled via a hinge and the outlet cover 120 pivots about a hinge pin. In one instance, the hinge is spring-loaded. The loading is configured to automatically move the outlet cover 120 to the extended position 168. A force opposing the spring tension is applied to pivot the outlet cover 120 away from the extension position 168 and toward the retracted position 172.

In still another embodiment, the outlet cover 120 translates or slides from a location parallel to the body 104 to the first or extended position 168.

An optional detent such as a latch or catch may be employed as an aid to maintaining the outlet cover 120 in position.

Figure 9:
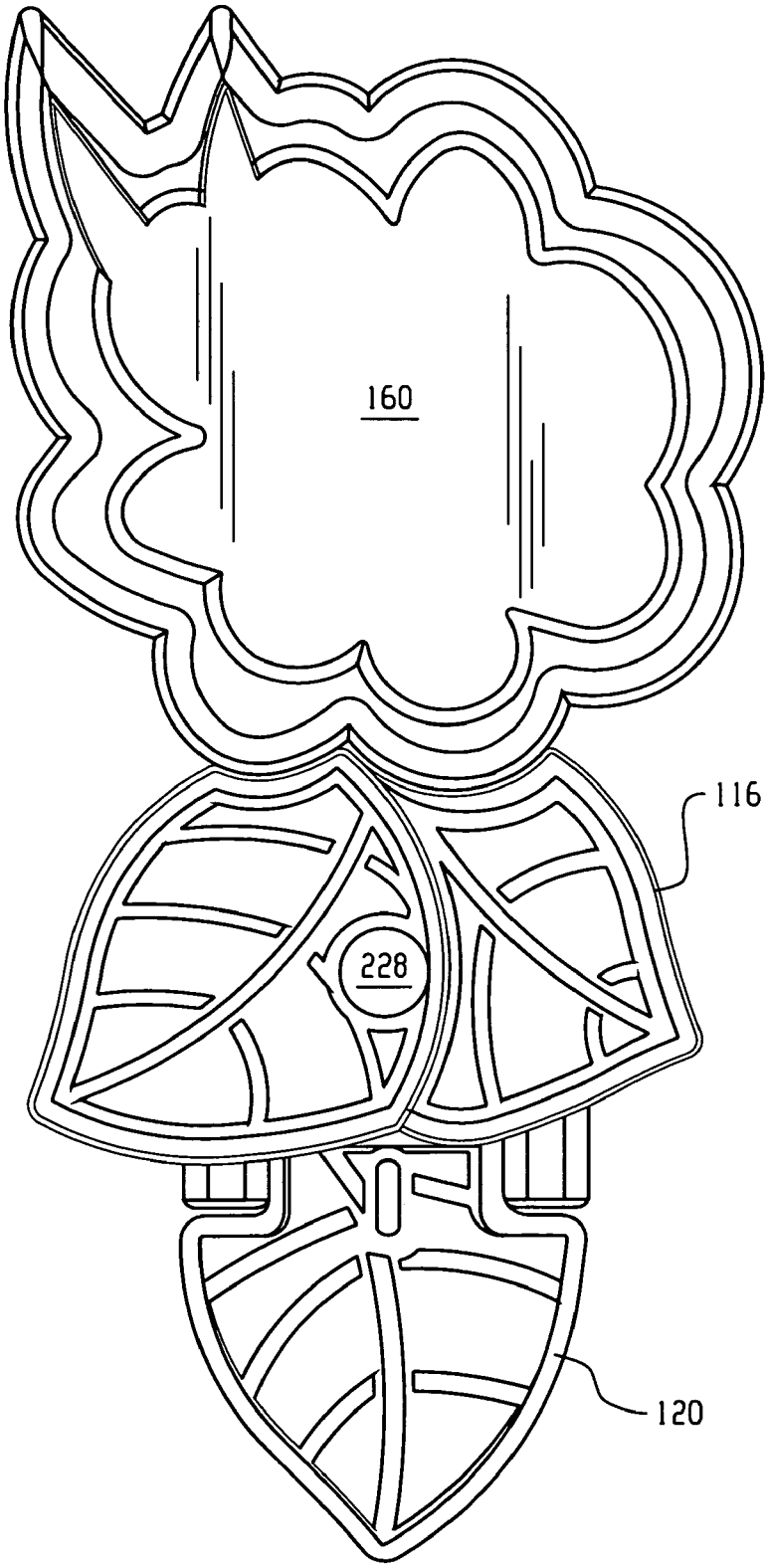
FIG. 9 illustrates a front view of the light device showing the outlet cover in an extended position.
Figure 10:
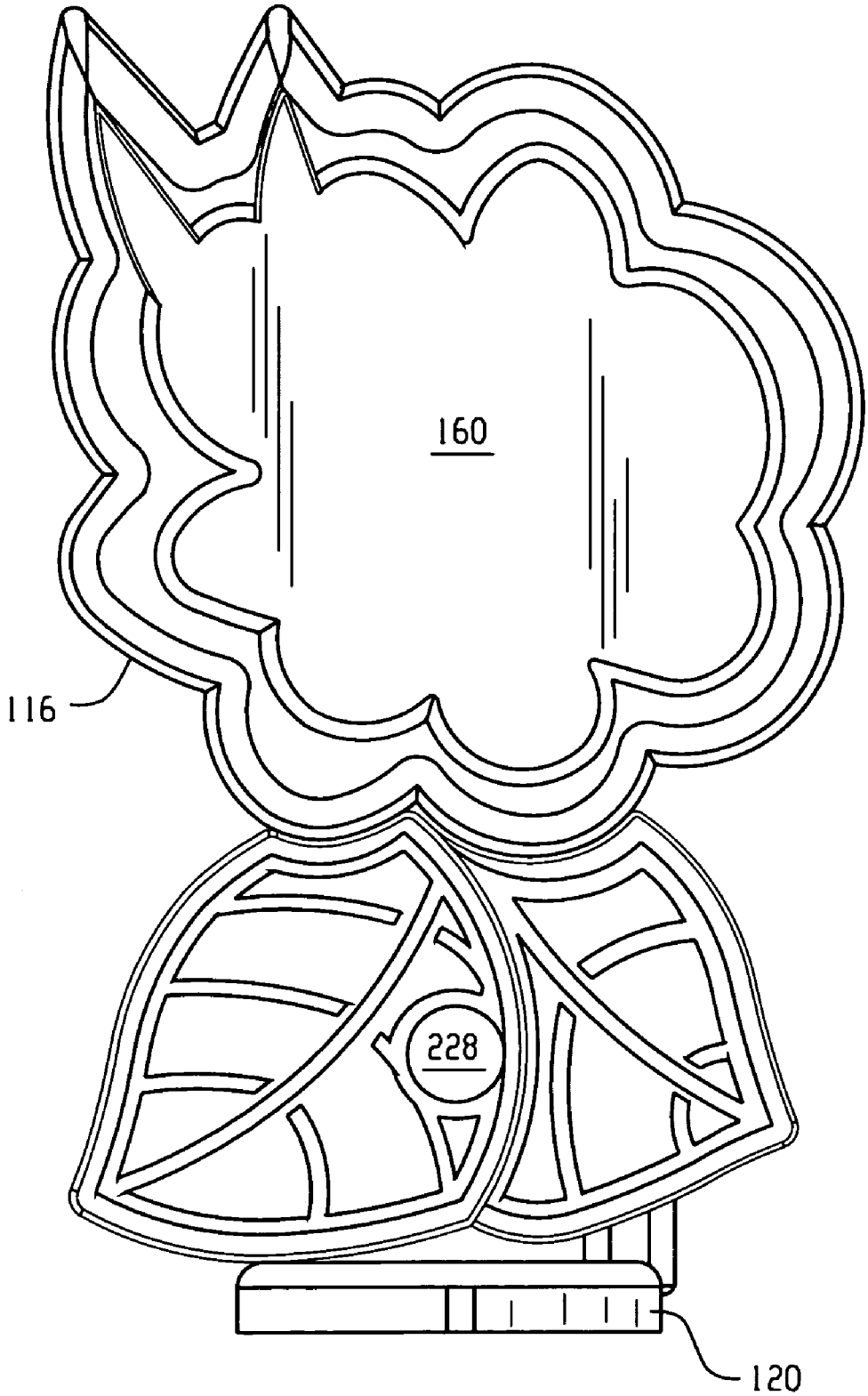
FIG. 10 illustrates front view of the light device showing the outlet cover in a retracted position.

FIGS. 9 and 10 illustrate a front view of the faceplate 116 and outlet cover 120 with the outlet cover 120 in the extended position 168 and in the retracted position 172, respectively. As depicted, the faceplate 116 and outlet cover 120 are aesthetically designed to provide a desired appearance such as a cartoon character when in either the extended or retracted positions 168 and 172. In the illustrated examples, the aesthetic designs of the faceplate 116 and the outlet cover 120 cooperate to provide an overall aesthetic design. In the illustrated embodiment, the overall aesthetic design is a cartoon character wherein the faceplate 116 represents a head and a clothed upper body and the outlet cover 120 represents a belt when in the retracted position 172 and a complementary clothed lower body when in the extended position 168. In the illustrated embodiment, the faceplate 116 includes a region 228 that allows ambient light to pass to the optical sensor.

Exemplary modifications and further alternatives are described next.

As described above, the light 100 illustrated in FIG. 1 is designed to receive a four (4) W incandescent light bulb. In other embodiments, the light source 100 is configured to receive light sources rated at greater or less wattage. In addition, other types of lights such as, but not limited to, a light emitting diode (LED), an electroluminescent light, a neon or other gas discharge light, optical fiber, or a fluorescent light. In these instances, the light receiving portion 124 corresponds to the type of light source used.

In the illustrated embodiment, the light device 100 has two non-polarized electrical contacts 112. In another embodiment, the light device 100 includes two polarized electrical contacts. In yet another embodiment, the light device 100 has three electrical contacts, including a hot, a neutral, and a ground contact. In addition, the light device 100 can be configured for electrical receptacles providing 240 VAC 50/60 Hz.

The illustrated light source 120 is activated through an optical sensor. However, in one alternative embodiment, the light 100 includes a switch, a push button, or the like, either alone or in combination with the optical sensor. In another alternative embodiment, the light source 108 is turned on simply by plugging the light 100 into an active electrical outlet.

In another embodiment, the optical portion 160 of the faceplate 116 is configured to collimate, attenuate, or otherwise affects the characteristics of the light emitted by the light source 120.

In another embodiment, the light device 100 is secured to the receptacle 136 via the body 104. In such embodiment, the outlet cover 120 can also be secured to the receptacle 136 as described above.

In another embodiment, the light 100 is configured to attach to electrical receptacles with a screw hole located in other regions such as outside of the outlets 132 and 150 on the receptacle 136 rather than between the outlets 132 and 150. In this embodiment, the outlet cover 120 can be configured with an additional or alternative suitably placed slot 184 for securing the outlet cover 120 to a screw hole located below the second outlet 150. In addition, the faceplate 116 can be configured with a slot 184 for attaching the faceplate 116 to a screw hole located above the first outlet 132. In this instance, the faceplate 116 may include a member that facilitates attaching the screw to such screw hole, for example, hollow member that extends from the slot 184 on the faceplate to the screw hole in the receptacle.

In another embodiment, the faceplate 116 and outlet cover 120 are removably attached to the body 104. As such, either or both can be permanently removed. In addition, the faceplate 116 and outlet cover 120 can be removed and replaced with a different faceplate and outlet cover having a different design or appearance. In another instance, the faceplate 116 and outlet cover 120 are generally permanently attached to body 104 through an adhesive, rivet, or the like. In still another instance, the faceplate 116 is omitted.

In another embodiment, the outlet cover 120 attaches to the faceplate 116.

Figure 11:
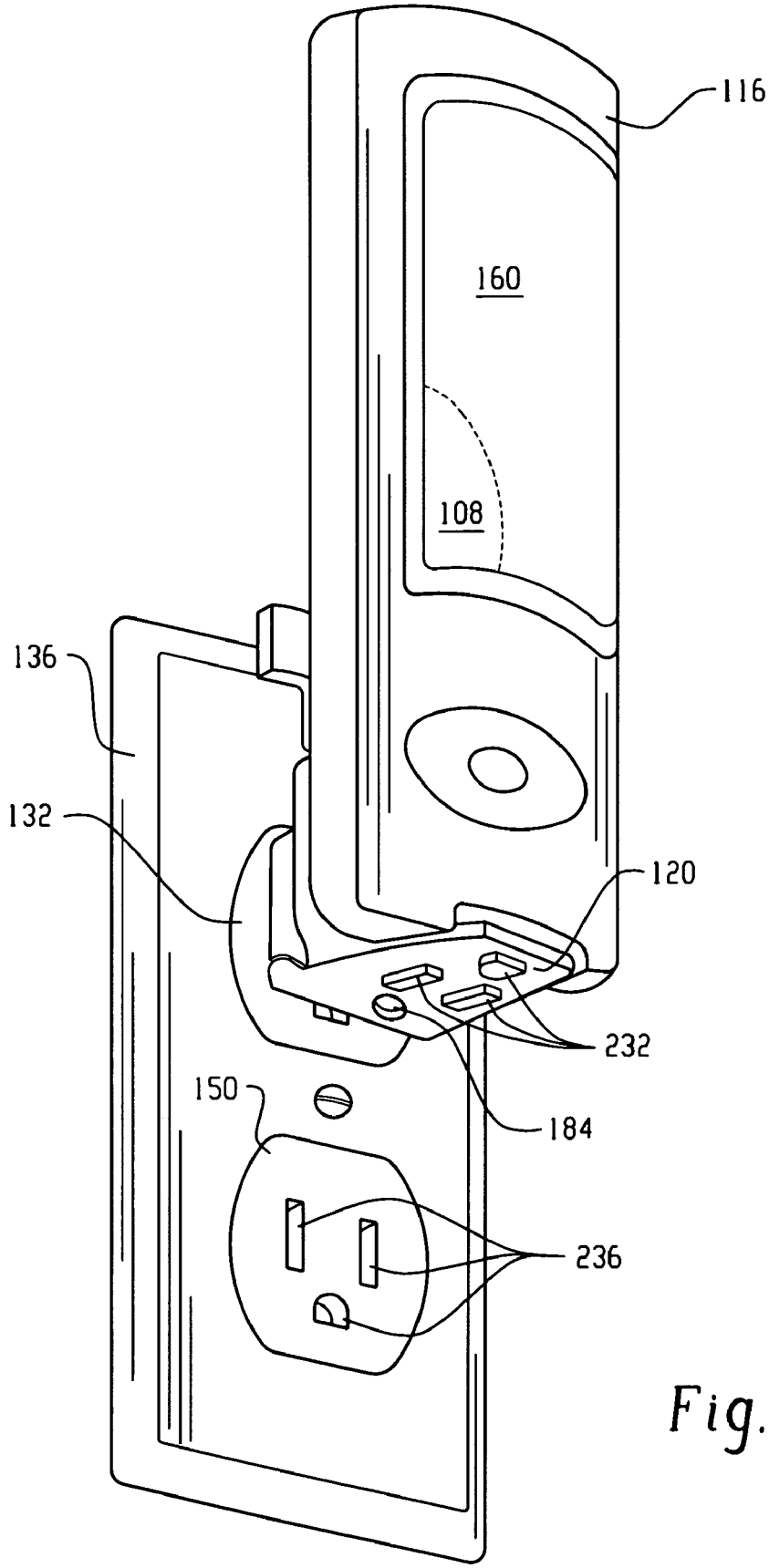
FIG. 11 illustrates a light device having an outlet cover with members that protrude into the contact recesses of the outlet.

FIG. 11 illustrates an embodiment in which the outlet cover 120 includes members 232 that at least partially protrude into the contact recesses 236 of the second outlet 150 when the outlet cover 120 is in the extended position 168. In one instance, the members 232 further hinder access to the outlet. In another instance, the members 232 facilitate aligning the slot 184 when using the screw to secure the outlet cover 120 in place. Although FIG. 11 depicts three (3) members 232, it is to be appreciated that in other embodiments the outlet cover 120 is configured with two (2) or less such members for use with the illustrated grounded electrical outlet or a non-grounded electrical outlet. For example, in one instance the outlet cover 120 is configured with two (2) members 232, each sized to fit the smallest slot or recess in a polarized outlet. This allows the outlet cover 120 to be used with an outlet that is installed upside down relative to standard installation.

In another embodiment, the faceplate 116 includes a region for holding a scented material such as an oil or liquid. Such material may dissipate through a tactile mechanism, electronically, or heat from the light source 120.

In another embodiment, the light device 100 is formed as part of the receptacle cover.

Figure 12:
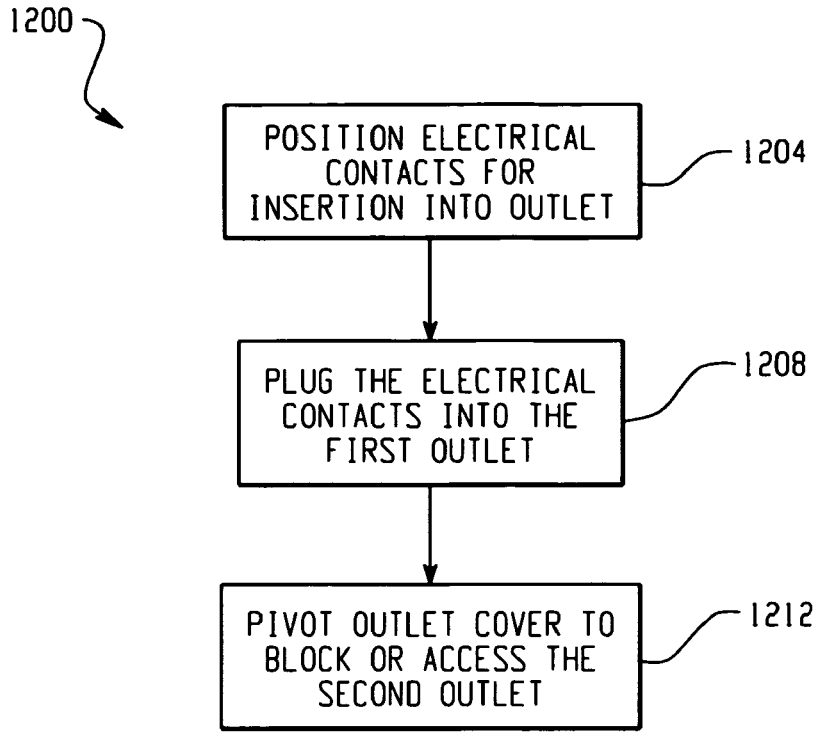
FIG. 12 illustrates a method for using a light having an outlet cover that blocks access to a second electrical outlet.

FIG. 12 illustrates a method for using the light 100. At 1204, the electrical contacts 112 are positioned so that they can be inserted into an electrical outlet, if not already positioned as such. At 1208, the electrical contacts 112 are plugged into a first outlet 132. Depending on the position of the outlet cover 120, it either blocks or provides access to the second outlet 150. At 1212, the outlet cover 120 is moved to gain or block access to the second outlet 150.

Figure 13:
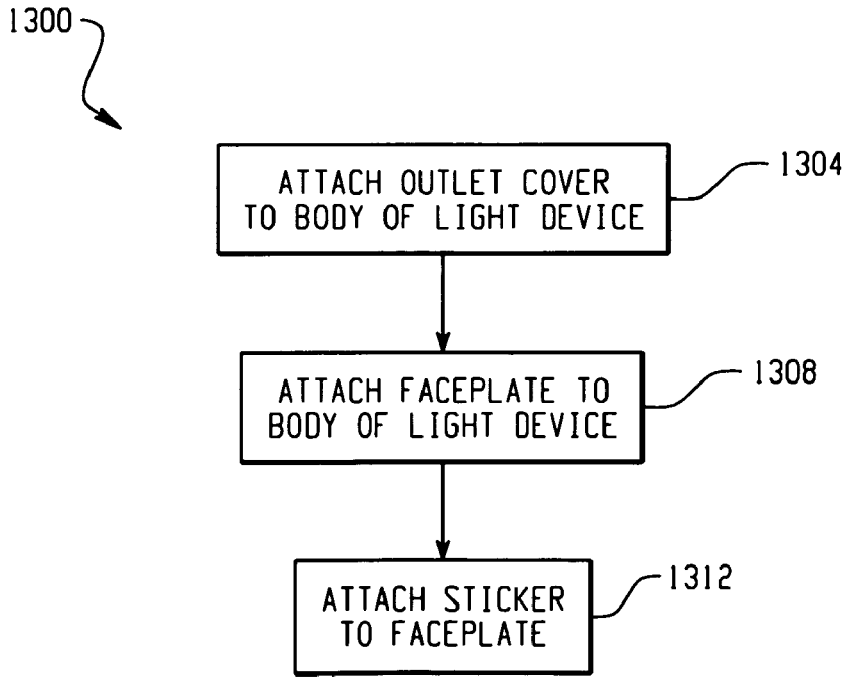
FIG. 13 illustrates a method for constructing a light.

FIG. 13 illustrates a method of constructing a modular light device. At 1304, an outlet cover 120 from a set of one or more outlet covers 120 with different designs is selected and attached to the body 104 of the light device 100. At 1308, the optional faceplate 116 is also attached to the body 104. If utilized, at 1312, a sticker or the like is affixed to the optical member 160.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the Doctrine of Equivalents.

What is claimed is:

1. A light device, comprising:

a body, including a light source, and electrical contacts that plug into a first electrical outlet of a duplex receptacle and supply power to the light source; and a outlet cover mounted for pivotal motion with respect to the body about a pivot axis that is substantially proximate to a region between the first outlet and a second outlet of the receptacle, wherein the outlet cover pivots away from the body and towards the duplex receptacle to inhibit access to the second electrical outlet.

2. The light device of claim 1, wherein outlet cover pivots towards the body and away from the duplex receptacle to provide access to the second electrical outlet.

3. The light device of claim 1, wherein the outlet cover includes a slot through which a screw attaches to a screw hole in the electrical receptacle to secure the outlet cover in position.

4. The light device of claim 1, further including a pivot that extends through the pivot axis, wherein the outlet cover pivots about the pivot.

5. The light device of claim 1, further including two or more pivots, wherein each pivot extends through a different portion of the pivot axis and the outlet cover pivots about the more than one pivot.

6. The light device of claim 1, wherein the body further includes one or more integral pivots that engage the outlet cover at the pivot axis and the outlet cover pivots about the one or more pivots.

7. The light device of claim 1, wherein the outlet cover includes one or more integral pivots that engage the body at the pivot axis and the outlet cover pivots about the one or more pivots.

8. The light device of claim 1, further including a hinge pin at which the outlet cover pivots.

9. The light device of claim 1, further including a detent that holds the outlet cover in a retracted position that allows access to the second outlet.

10. The light device of claim 1, further including a faceplate attached to the body that facilitates spreading light emitted by the light source.

11. The light device of claim 10, wherein the faceplate has a recessed surface and a translucent sticker is affixed to the surface.

12. The light device of claim 10. wherein the outlet cover is substantially parallel to the region between the first outlet and a second outlet of the receptacle.

13. A night light that receives power through an electrical connection with an electrical outlet of a duplex receptacle, comprising:

a light source that is energized by the power from a first outlet of the duplex receptacle;

a pivot disposed near to a region between two outlets of the receptacle; and an extension that pivots about the pivot to block access to a second electrical outlet of the duplex receptacle.

14. The night light of claim 13, wherein the extension is breakably removable from the night light.

15. The night light of claim 13, wherein the pivot is a flexible member that flexes to pivot about the pivot.

16. The night light of claim 13, further including an optical sensor that senses ambient light and activates the light source,

17. The night light of claim 13, wherein the light source is one of an incandescent light, a light emitting diode, a neon light, an electroluminescent light, a gas discharge light, an optical fiber, and a fluorescent light.

18. The night light of claim 13, further including a body, wherein the body and the extension include material free regions in which the pivot extends.

19. The night light of claim 18, wherein the pivot is held in the material free regions via an interference fit.

20. The night light of claim 13, wherein the pivot is a hinge pin.

21. The night light of claim 13, wherein the pivot is an integral part of the extension.

22. The night light of claim 13, further including a body, wherein the pivot is an integral part of the body.

23. The night light of claim 13, wherein the outlet cover includes a plurality of members that are at least partially inserted into the outlet recesses to inhibit use of the outlet.

24. The night light of claim 13, wherein the extension pivots away from the body and towards the duplex receptacle to inhibit access to the second electrical outlet.

25. A method for attaching a nightlight to an electrical outlet, comprising:

electrically coupling electrical contacts of the night light to a first outlet of an duplex electrical receptacle; and pivoting an outlet cover of the night light about a pivot axis located between and parallel to the outlets of the receptacle to prevent access to a second outlet or provide access to the second outlet.

26. The method of claim 25, further including securing the outlet cover in a position that prevents access to the second outlet with a screw.

27. A method for constructing a night light that blocks access to an electrical outlet, comprising:

assembling a night light that plugs into an outlet of a duplex electrical receptacle; and pivotably coupling an extension member to a pivot axis of the night light located between the outlets of the receptacle, wherein the extension member pivots about the axis towards the receptacle to block access to a second outlet of the receptacle.

28. The method of claim 27, further including:

selecting a faceplate from at least two faceplates having different designs; and attaching the selected faceplate to the night light.

29. The method of claim 28, further including selecting the extension member from at least two extension members having different designs based on the design of the selected faceplate.

30. The method of claim 27, further including affixing a sticker to the faceplate.

* * * * *